US005480588A

United States Patent [19]

Tomasiak et al.

[11] Patent Number: 5,480,588

[45] Date of Patent: Jan. 2, 1996

[54] HUMIDIFIER WITH EXPOSED SPACED BOTTLES

[75] Inventors: Mark J. Tomasiak, O'Fallon; Gregory F. Dix, Florissant, both of Mo.; John F. Moody, Bunker Hill, Ill.

[73] Assignee: Emerson Electric Co., St. Louis, Mo.

[21] Appl. No.: 349,189

[22] Filed: Dec. 5, 1994

[51] Int. Cl.[6] ..... B01F 3/04

[52] U.S. Cl. ..... 261/72.1; 261/104

[58] Field of Search ..... 261/72.1, 104, 261/107

[56] References Cited

U.S. PATENT DOCUMENTS

| | | | |
|---|---|---|---|
| D 337,634 | 7/1993 | Copland et al. | D23/356 |
| 4,865,775 | 9/1989 | Steiner et al. | 261/24 |
| 5,034,162 | 7/1991 | Chiu | 261/24 |
| 5,037,583 | 8/1991 | Hand | 261/26 |
| 5,061,405 | 10/1991 | Stanek et al. | 261/104 |
| 5,067,169 | 11/1991 | Chiu | 392/406 |
| 5,110,511 | 5/1992 | Hand | 261/104 |
| 5,133,904 | 7/1992 | Pepper | 261/24 |
| 5,250,232 | 10/1993 | Pepper et al. | 261/24 |
| 5,397,510 | 3/1995 | Clark | 261/107 |

OTHER PUBLICATIONS

Groupe.21—Acquamat humidifiers.

*Primary Examiner*—Tim R. Miles

*Attorney, Agent, or Firm*—Polster, Lieder, Woodruff & Lucchesi

[57] ABSTRACT

A humidifier with exposed spaced water bottles is disclosed. The humidifier includes a water reservoir base having a central portion and spaced end portions. A humidification unit is mounted on the central portion of the base. Spaced water bottles are mounted on the spaced end portions of the base for dispensing water into the base. The bottles are positioned immediately adjacent to and on opposite sides of the humidification unit. The bottles are individually removable from the base for refilling; however, they also provide jointly operating lifting and carrying elements for lifting and carrying the humidifier. Each of the water bottles have a separate water dispensing opening and associated water dispensing cap that is separate from a water filling opening and associated water filling cap. The water dispensing opening is provided in the bottom wall of the container while the water filling opening is provided in the side wall of the water bottle to facilitate filling.

28 Claims, 5 Drawing Sheets

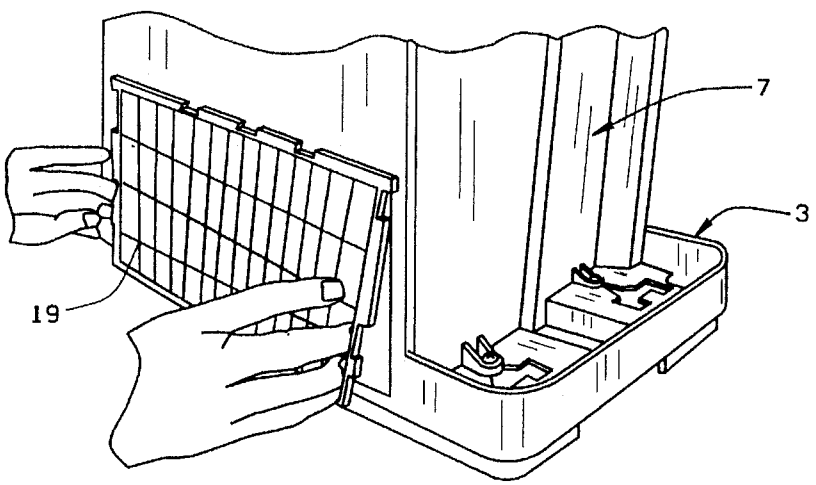
FIG. 6
FIG. 7
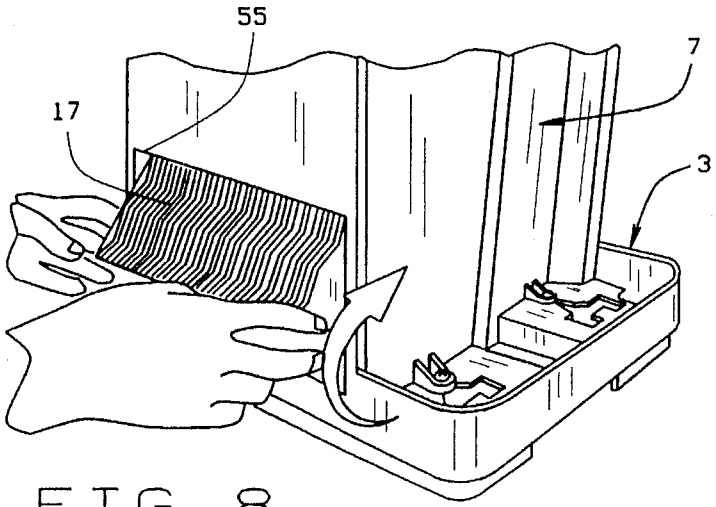
FIG. 8
FIG. 9

HUMIDIFIER WITH EXPOSED SPACED BOTTLES

BACKGROUND OF THE INVENTION

The present invention relates to a humidifier with exposed spaced water bottles which are constructed to facilitate filling as well as the carrying of the humidifier, and more particularly, to a humidifier with exposed spaced water bottles that are individually removable from the humidifier while also jointly operating to permit lifting and carrying of the humidifier.

Humidifiers are principally used during the winter season to add moisture to room air. As is well know, heated rooms normally tend to have low moisture conditions which causes numerous problems. These include health problems/discomfort to occupants of the rooms, drying out of furniture, excessive static electricity and other problems. With regard to personal health and comfort, humidified air can make the air feel warmer at relatively cool temperatures. Humidified air also protects the body's respiratory system, aiding the body's defenses against viruses and air pollutants. The moisture a humidifier supplies to heated air can help cold sufferers feel better by reducing dryness and irritation in the nose and throat. Humidification can also alleviate atopic dermatitis attributable to dry air. A humidifier can also reduce static electricity, protect wood furniture, paneling and fabrics, and even protect computers from excessive dry warm air.

While there is general agreement on the many advantages that humidified air can provide, there is no agreement on the type and kind of humidifier that should be constructed. Over the years, there have been many different types and varieties of humidifiers that have been developed including centrifugal pump/evaporative filter humidifiers, air blown wicking/evaporative element humidifiers, motor driven belt pad humidifiers, wicking element humidifiers, and other types. The present invention is primarily directed to a wicking element type humidifier that is principally constructed for use as a console or floor mounted humidifier. Typically, there are two broad categories of humidifiers: table top and floor mounted or console humidifiers, The present invention is a floor mounted humidifier; however, as will be seen in the discussion that follows, it has many aspects of a table top humidifier, as well.

SUMMARY OF THE INVENTION

Among the several objects and advantages of the present invention may be noted;

The provision of a humidifier which includes spaced exposed water bottles to facilitate removal of individual water bottles from the humidifier for filling purposes;

The provision of the aforementioned humidifier where the exposed spaced water bottles, when mounted to the humidifier, also permit joint carrying and lifting of the humidifier as a unit;

The provision of the aforementioned humidifier which eliminates the mounting of water bottles inside of another cabinet, thus eliminating the need for duplication of walls and extra material of such prior art designs;

The provision of the aforementioned humidifier which incorporates the exposed spaced water bottles as an integral part of the overall design of the humidifier to eliminate extra material and duplicated walls;

The provision of a new and improved water bottle construction for a humidifier in which a water bottle facilitates the separate functions of filling and dispensing of water from the water bottle;

The provision of the aforementioned improved water bottle construction which includes a water dispensing opening in the bottom wall of a water bottle and a separate water filling opening in the side wall of the water bottle for independent operation and use;

The provision of the aforementioned humidifier which further includes an improved construction to facilitate removal of a filter from the exterior of the unit; and The provision of the aforementioned humidifier and water bottle construction which is simple to manufacture using well-known injection molding/blow molding techniques; easy to use and maintain; is durable and long-lasting; and is otherwise well adapted for the purposes intended.

Briefly stated, the humidifier of the present invention includes a water reservoir base having a central portion and spaced end portions. A humidification unit is mounted on the central portion of the base. Spaced water bottles are mounted on the spaced end portions of the base for dispensing water into the base. The bottles are positioned immediately adjacent to and on opposite sides of the humidification unit. Each bottle is individually removable from the base for refilling. The bottles include jointly operating lifting and carrying elements for lifting and carrying the humidifier.

The jointly operating lifting and carrying elements include a handle at an upper end of each bottle. The handle may be integrally molded in each bottle at an upper end. An elongated opening is preferably formed in each handle below an upper end of each bottle.

The jointly operating lifting and carrying elements further include complementary engaging male and female elements at a lower end of each bottle and base. The lower end of each bottle includes at least one depending prong for reception within an opening provided in the base. The depending prong and base opening have complementary engaging male and female components for releasably engaging one another.

The complementary engaging male and female components of the depending prong and base opening include a tang extending within the base opening for engaging a corresponding opening provided in the depending prong. The complementary male and female elements include at least one depending U-shaped prong for reception with an opening provided in the base and a tang extending from one side of the base opening for reception within the depending U-shaped prong when each bottle is mounted on the base.

Preferably, each bottle includes a spaced pair of depending U-shaped prongs for reception within corresponding base openings. An outwardly extending tang extends from one side of the corresponding base openings for releasable engagement with the depending U-shaped prongs from each bottle.

In order to remove each bottle from the base, the bottles must be tilted outwardly relative to the humidification unit to position the U-shaped prongs for releasable engagement with respect to the spaced tangs of the corresponding base openings.

To facilitate removal of a filter within the humidification unit, a removable grill is mounted over an opening on the humidification movement to permit exterior removal of the filter through the opening. Preferably, the filter has a heighth greater than the opening in the humidification unit and a width less than the opening. This requires the filter to be rotated for insertion or removal into or from the opening in the humidification unit.

Each water bottle is also constructed with a bottom wall, a top wall and opposed pairs of side walls having a substantial heighth and being integrally connected to the bottom wall and top wall. One opposed pair of side walls defines the depth of the water bottle while the other opposed pair of side walls defines the width of the water bottle. One opposed pair of side walls is spaced from each other by a substantially greater dimension than the other opposed pair of side walls. A water dispensing cap is mounted over the water dispensing opening provided in the bottom wall of the container. A water filling cap is releasably mounted over a water filling opening provided in one side wall of one of the opposed pairs of side walls to facilitate filling.

The water filling opening is provided in one side wall of the one opposed pair of side walls having a substantially greater dimension than the other opposed pair of side walls. The water filling opening is provided in the one side wall immediately adjacent to the bottom wall. The water filling opening and a corresponding water filling cap has a substantially greater dimensional extent than the water dispensing opening and its associated water dispensing cap. Preferably, the water filling cap is threadably mounted to the water filling opening.

These and other objects and advantages of the present invention will become apparent from the description that follows.

BRIEF DESCRIPTION OF THE DRAWINGS

In the drawings.

FIG. 6 is a fragmentary perspective view of the rear of the humidifier illustrating removal of an exterior grill from the humidifier;

FIG. 7 is also a fragmentary perspective view of the rear of the humidifier illustrating further removal of the grill from the exterior of the humidifier;

FIG. 8 is a further fragmentary perspective view illustrating the removal of a filter from an opening in the humidifier, once the grill is removed as shown in FIG. 6–7, by rotating the filter in order to permit removal; and FIG. 9 is a fragmentary perspective view illustrating the final removal of the filter from the opening in the humidifier.

Corresponding reference numerals will be used throughout the several figures of the drawings.

DESCRIPTION OF THE PREFERRED EMBODIMENTS

Figure 1:
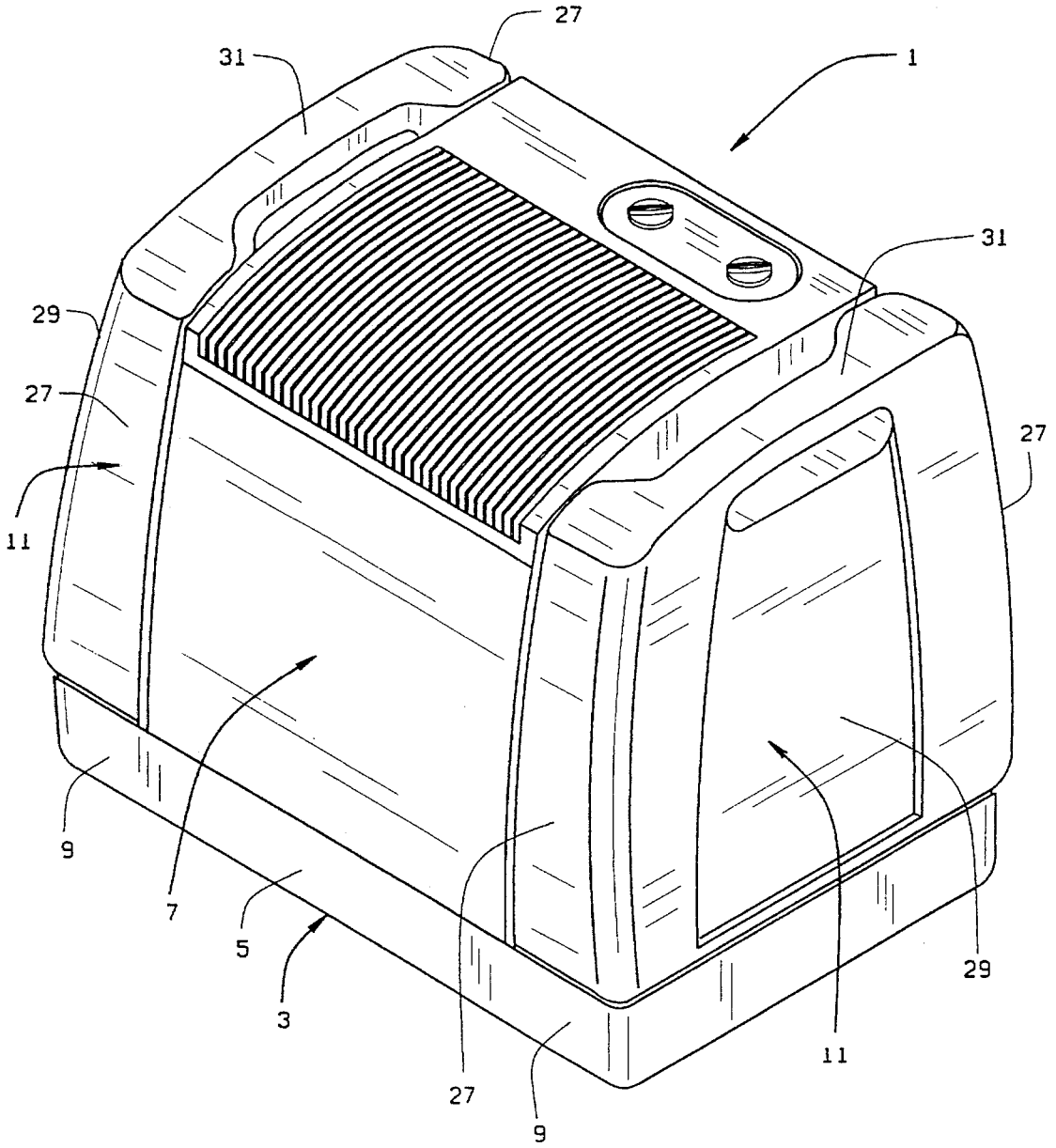
FIG. 1 is a top perspective view of the humidifier with exposed spaced water bottles constructed in accordance with the teachings of the present invention.
Figure 2:
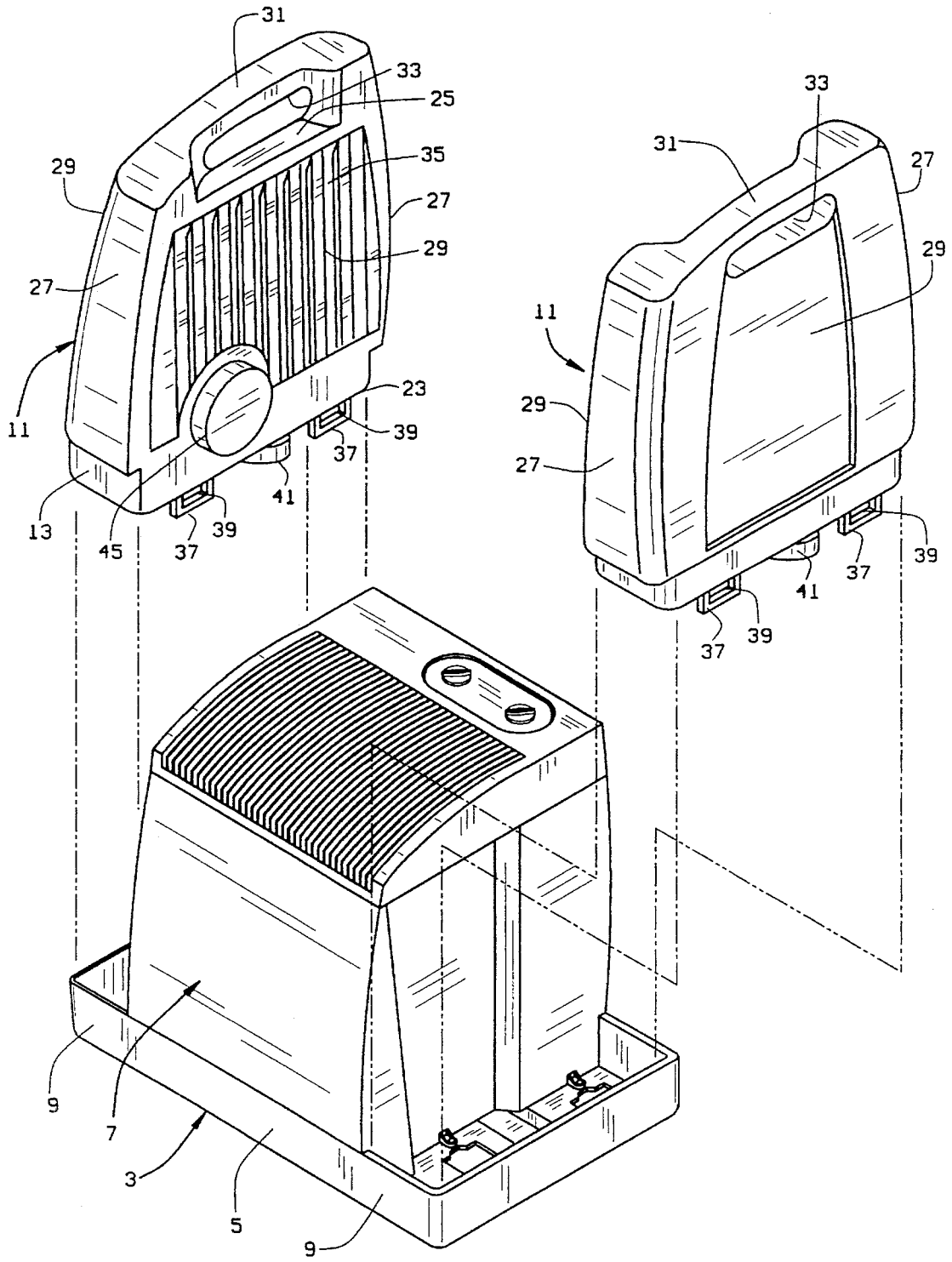
FIG. 2 is an exploded perspective view of the humidifier with spaced water bottles illustrated as being separate from the humidification unit and base.

The following detailed description illustrates the invention by way of example and not by way of limitation. This description will clearly enable one skilled in the art to make and use the invention, and describes several embodiments, adaptions, variations, alternatives and uses of the invention, including what we presently believe is the best mode of carrying out the invention.

The humidifier 1 of the present invention is a mid-size console or floor mounted humidifier of the wicking element type. As will be appreciated from the discussion that follows, the humidifier 1, while being a mid-size console or floor mounted unit, also has features common to table top humidifier units. Thus, the humidifier 1 has some features similar to table top model units, although it is principally designed to be a mid-size console or floor mounted humidifier unit.

The humidifier 1 includes a water reservoir base 3 with an upstanding rectangular-shaped circumferential wall for receiving a humidification unit and spaced water bottles. Specifically, the water reservoir base 3 has a central portion 5 for receiving a humidification unit 7 and spaced end portions 9, 9 for receiving spaced water bottles 11, 11. At the lower end of each bottle 11, a three sided indented area 13 is constructed in order to permit reception of same within the upstanding rectangular shaped wall of the water reservoir base 3. This provides support to the water bottles 11 as well as provides a combined overall aesthetic look and appearance to the humidifier 1, as will be appreciated.

Within the humidification unit 7, a motor drive fan 15 (see FIG. 4) and a wicking filter 17 (see FIGS. 8–9) are provided. The wicking filter 17 is designed to rest within the water reservoir base 3 to provide sufficient absorption capacity and capillary action to wick water vertically by capillary action along the entire heighth of the wicking element or filter 17. In this way, the absorbent and capillary wick element 17 soaks up water that is dispensed from the water reservoir bottles 11 into the water reservoir base 3.

Figure 4:
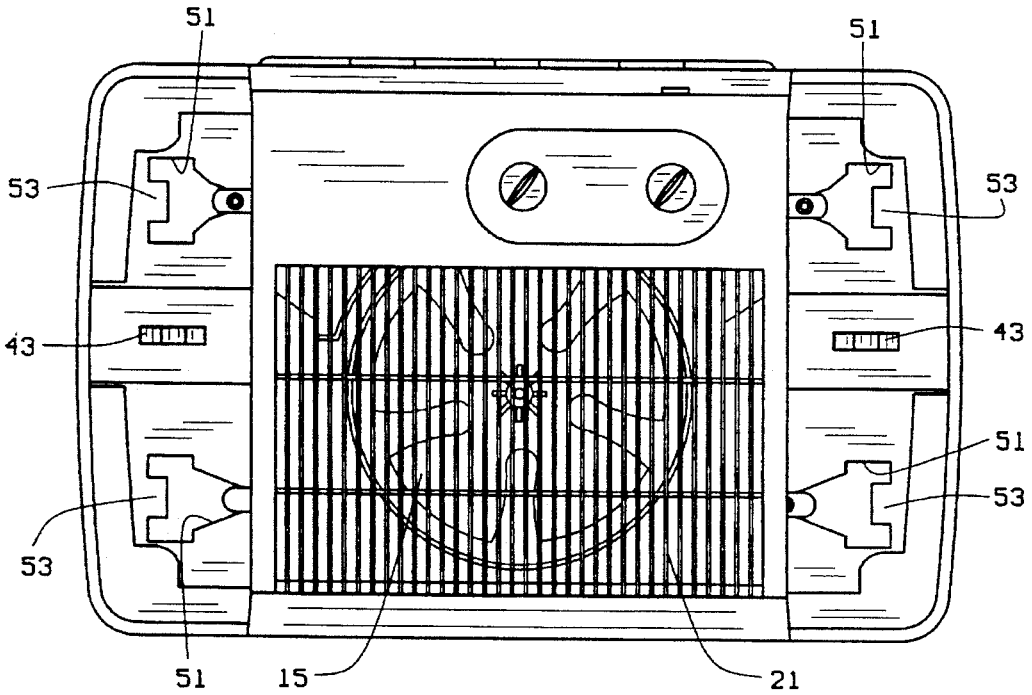
FIG. 4 is a top plan view of the humidification unit and base without the spaced water bottles.
Figure 5:
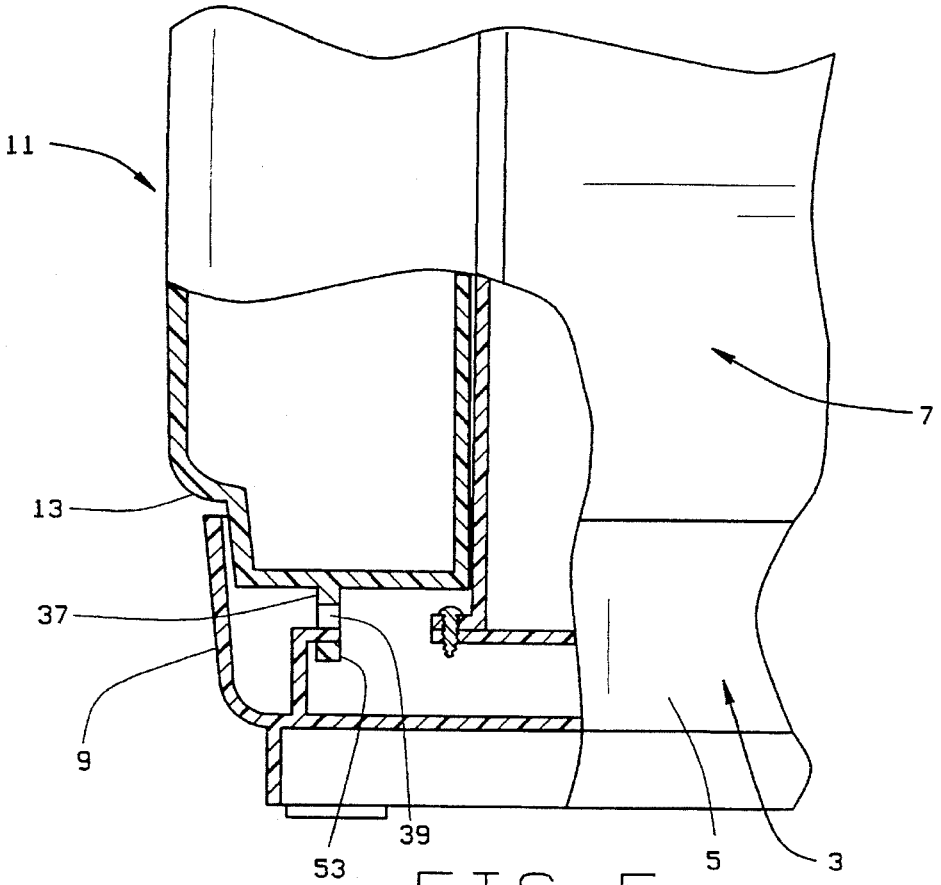
FIG. 5 is a fragmentary side elevational view, partially in section, illustrating the manner in which one of the exposed spaced water bottles is mounted with respect to the base of the humidifier.

The humidifier 1 operates in a manner similar to other wicking element humidifiers, such as disclosed in U.S. Pat. Nos. 4,865,775 and 5,061,405. In general, this is accomplished by the motor driven fan 15 drawing outside air through the open grill 19 at the rear of the humidifier 1, allowing the outside air to pass through the wicking element or filter 17 so that moisture is absorbed into the air and then released through the open grill 21 at the top of the humidifier 1, as seen in FIGS. 4–5 of the drawings. Because evaporation in the air takes place in the humidifier 1, moist air is released in the form of vapor, with no water droplets entering the home. Furthermore, any residue left by the evaporating is not passed into the home, but remains in the wicking element or filter 17. Preferably, the wicking element or filter should be replaced at least once a season or more often, as may be necessary. The operating components within the humidification unit 7 may be varied as may be desired in order to achieve maximum and efficient humidification.

The present invention is directed to the water reservoir bottles 11 and the manner in which they are mounted and/or associated within the humidifier 1.

As described above, the spaced water bottles 11, 11 are mounted on the spaced end portions 9, 9 of the water reservoir base 3 immediately adjacent to and on opposite sides of the humidification unit 7 and are supported by the spaced end portions 9, 9 of the water reservoir base 3. By using the water bottles 11, 11 as an integral part of the overall humidifier design, this eliminates extra material of outside cabinet walls in typical console or floor mounted humidifiers. In addition, the water bottles 11, 11 are individually removable from the water reservoir base 3 while also providing lifting and carrying means for lifting and carrying the humidifier 1.

In order to understand how the water bottles 11, 11 are individually removed from the water reservoir base 3 while also jointly operating to provide lifting and carrying elements for the humidifier 1, the construction of each water bottle 11 must first be understood. This will also facilitate an understanding of how the water bottles 11 have a unique filling system as compared with prior art water bottles.

Each water bottle 11 has a bottom wall 23, a top wall 25 and interconnecting side walls which extend between the bottom wall 23 and top wall 25. In the illustrated embodiment, the side walls comprised opposed pairs of side walls 27, 27 and 29, 29. The opposed pairs of side walls 27, 27 are spaced from each other by a substantially greater distance than the other opposed pair of side walls 29, 29. This provides each water bottle 11 with a substantial heighth and width, but a much smaller depth in the illustrated embodiment. This particular construction also facilitates the mounting of the spaced water bottles 11,11 on opposite sides of the humidification unit 7.

A handle 31 is provided at the upper end of each bottle 11. The handle 31 is an integrally molded handle formed in each bottle 11 with an elongated opening 33 formed below the integrally molded handle 31 for insertion of user's fingers and for grasping the integrally molded handle 31. The inside face of the opposed pairs of side walls 29, 29 includes a series of reinforcing ribs 35 for reinforcing the bottles, as will be appreciated.

Extending downwardly from the bottom wall 23 of each bottle 11 are a pair of spaced U-shaped depending prongs 37, 37, each of which have an opening 39 for purposes presently to be described. A dispensing cap 41 is mounted in a centrally located position of the bottom wall 23 between the spaced depending prongs 39, 39. The dispensing cap 41 is threadably mounted to a depending spout (not shown) that extends from the bottom wall 23 in the same manner as shown in U.S. Pat. No. 5,061,405. As is common in the prior art and as is disclosed in U.S. Pat. No. 5,061,405, the dispensing cap 41 is provided with a spring biased valve stem which is normally operative to prevent any water from being discharged through the dispensing cap 41. However, when the spring biased valve stem 42 (FIG. 3) engages a fixed button valve actuator 43 (FIG. 4) in the water reservoir base, water from the water bottles 11 is discharged or emptied into the water reservoir base 3 until water in the water reservoir base 3 reaches a predetermined level, at which point the flow of water will be stopped until air is permitted to again enter the water bottle 11. The dispensing cap 41 in each water bottle 11 thus operates in the same manner as U.S. Pat. No. 5,061,405 and other prior art designs.

However, unlike other prior art designs, each water bottle 11 has a water filling cap 45 which is threadably mounted to an externally threaded spout 47 that surrounds a water filling opening 49 provided in the inside face of one opposed side wall 29, 29.

Figure 3:
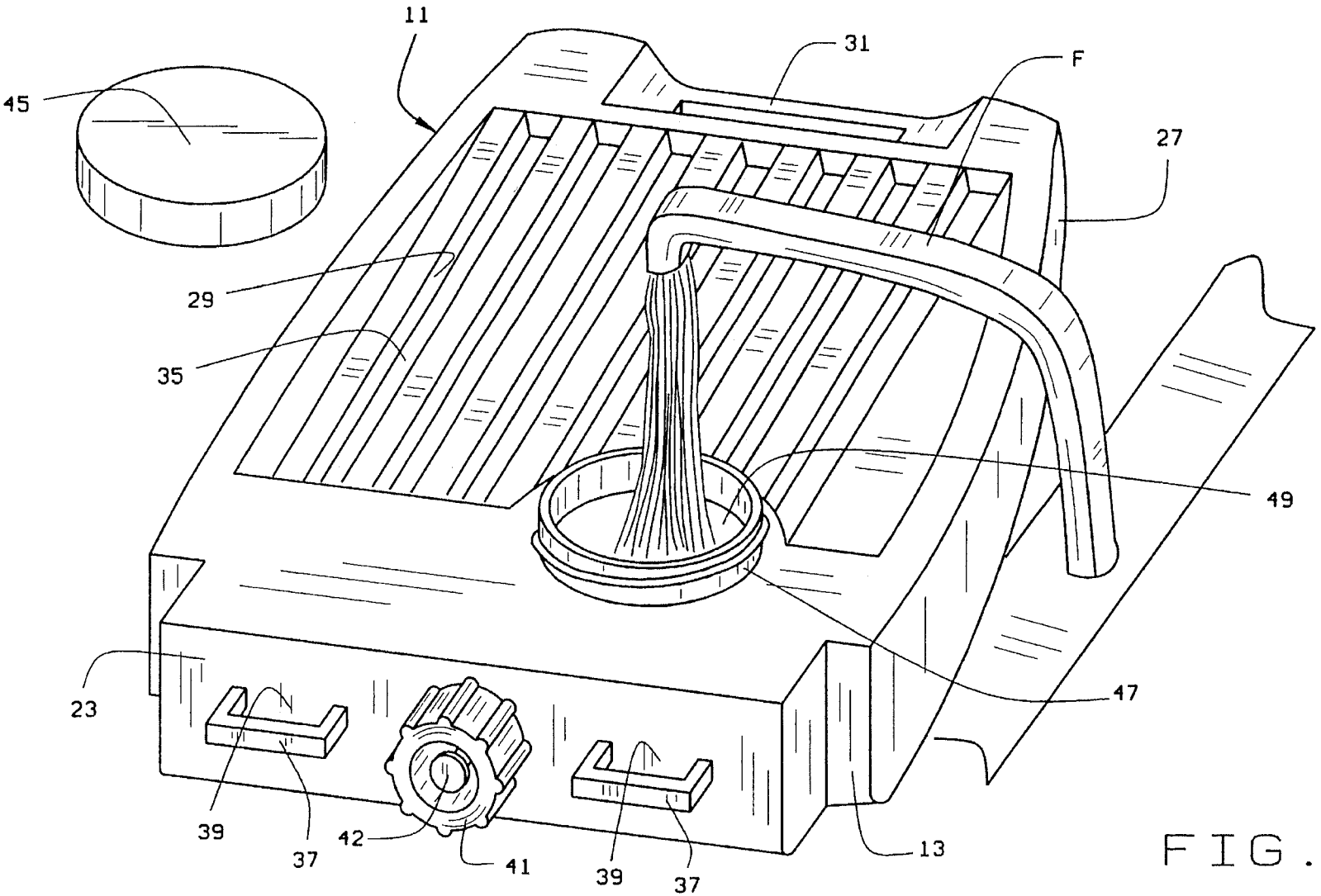
FIG. 3 is a perspective view of one of the water bottles showing its new and improved construction to facilitate filling of the water bottle independent of water dispensing.

As shown in FIG. 3 of the drawings, each water bottle 11 can be rotated to the position illustrated for easy positioning under a water faucet F to allow filling of each water bottle 11 through the water filling opening 49. After each water bottle 11 is filled, a user can simply threadably mount the water filling cap 45 relative to the externally threaded spout 47 that surrounds the water filling opening 49. The dispensing cap 45 and/or external spout 47 are provided with suitable sealing means to prevent any leakage or dripping of the water from the water bottle, as will be understood.

Thus, unlike other prior art designs where the dispensing and filling openings are mounted on the bottom wall of the water bottle, the construction of the water bottle 11 enables the dispensing cap 41 to be located on the bottom wall 23 of each water bottle while enabling the filling cap 45 is mounted on one of the side walls of the opposing pair of side walls 29, 29 to facilitate filling of each water bottle, as will now be apparent.

In order to enable each of the water bottles 11 to be supported by the water reservoir base while being individually removable therefrom, and at the same time provide jointly operating lifting and carrying elements for the humidifier 1, it will be seen that the spaced depending prongs 37, 37 are received within complementary shaped openings 51, 51 provided in the lower wall of the water reservoir base 3 in each of the spaced end portions 9, 9. Extending inwardly from each of the complementary openings 51 is a tang 53 for reception within an opening 39 of a depending prong 37.

As best seen in FIG. 5 of the drawings, the construction, arrangement and positioning of each depending prong 37 and its corresponding opening 39 causes the tang 53 to be positioned within the respective opening 39 of each depending prong 37 when each water bottle 11 is mounted within the water reservoir base 3. Thus, as long as each water bottle 11 is located in the position illustrated in FIGS. 1 and 5 of the drawings, a user can grasp both handles 31, 31 of the spaced water bottles 11, 11 and lift the entire humidifier unit 1. The respective interacting engagement between the tang 53 and a corresponding opening 39 out of a depending prong 37 will enable the spaced water bottles 11, 11 to function as jointly operating lifting and carrying means for lifting and carrying the humidifier 1. It will be understood that both water bottles 11, 11 must be gripped and lifted together in order to enable them to function as jointly operating lifting and carrying means for the humidifier 1. Each of the tangs 53 and depending prongs 37 with openings 39 serve as the jointly operating lifting and carrying elements for the water bottles 11,11.

However, an individual water bottle can be removed from the humidifier 1 by simply tilting same relative to the humidification unit 7. This will cause disengagement of the pair of spaced tangs 53, 53 with the spaced openings 39, 39 of the spaced depending prongs 37, 37, enabling an individual water bottle 11 to be quickly and easily removed from the humidifier 1 for filling.

FIGS. 6–9 of the drawings illustrate the manner in which the removable rear grill 19 can be quickly and easily removed from the rear of the humidification unit 7, in order to allow the filter 17 to be removed from the opening 55. As shown in FIG. 6, a screwdriver or other implement can be used to pry the removable rear grill 19 from the rear opening 55 at the rear of the humidification unit 7. This enables the user to grasp the removable rear grill 19 as shown in FIG. 7 for separating same from the humidification unit 7. The filter 17 can then be removed through the opening 55 as shown in FIGS. 8–9. It will be seen in FIGS. 8–9 that the filter 17 has a heighth greater than the opening 55. This requires the filter to be rotated by the user, as shown in FIG. 8, in order to allow the filter 17 to be inserted or removed from the humidification unit 7. The removable rear grill 19 can be simply and easily re-mounted to the humidification unit 7, as will be appreciated.

From the foregoing, it will now be appreciated that the humidifier of the present invention has a novel construction and arrangement of the spaced water bottles relative to a humidification unit. The individual water bottles can be quickly and easily removed from the humidifier, and at the same time, when mounted to the humidifier, can serve as jointly operating lifting and carrying means for the entire humidifier. Each water bottle is further constructed with a novel water filling system including a water dispensing cap that is threadably associated relative to an external spout surrounding a water filling opening in the side wall of each water bottle. This enables the user to conveniently and quickly fill each water bottle, while permitting each water bottle to dispense water into the water reservoir base through a water dispensing device along the bottom wall of each water bottle in a manner well known in the art.

It will now be seen that the several objects and features of the invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense.

We claim:

1. A humidifier comprising:

a water reservoir base having a central portion and spaced end portions;

a humidification unit mounted on the central portion of said base;

spaced water bottles mounted on the spaced end portions of said base for dispensing water into said base, said bottles being positioned immediately adjacent to and on opposite sides of said humidification unit:

said bottles being individually removable from said base for filling while also providing lifting and carrying means for lifting and carrying the humidifier.

2. The humidifier as defined in claim 1 wherein the lifting and carrying means are jointly operating lifting and carrying means for lifting and carrying the humidifier when jointly engaged.

3. The humidifier as defined in claim 1 wherein individual bottles are capable of being removed from the base independent of the operation of the lifting and carrying means.

4. A humidifier comprising:

a water reservoir base having a central portion and spaced end portions;

a humidification unit mounted on the central portion of said base;

spaced water bottles mounted on the spaced end portions of said base for dispensing water into said base, said bottles being positioned immediately adjacent to and on opposite sides of said humidification unit;

each said bottle being individually removable from said base for re-filling; and said bottles including jointly operating lifting and carrying elements for lifting and carrying the humidifier.

5. The humidifier as defined in claim 4 wherein the jointly operating lifting and carrying elements include a handle at an upper end of each said bottle.

6. The humidifier as defined in claim 5 wherein the handle at an upper end of each bottle includes an integrally molded handle formed in each bottle.

7. The humidifier as defined in claim 6 wherein the integrally molded handle for each bottle includes an elongated opening formed below an upper end of each bottle.

8. The humidifier as defined in claim 5 wherein the jointly operating lifting and carrying elements are releasable from each other when each bottle is individually removed from said base.

9. The humidifier as defined in claim 8 wherein the jointly operating lifting and carrying elements further include complementary engaging male and female elements at a lower end of each bottle and said base.

10. The humidifier as defined in claim 9 wherein the lower end of each bottle includes at least one depending prong for reception within an opening provided in said base, said depending prong and base opening having complementary engaging male and female components for releasably engaging one another.

11. The humidifier as defined in claim 10 wherein the complementary engaging male and female components of said depending prong and base opening including a tang extending within said base opening for engaging a corresponding opening provided in said depending prong.

12. The humidifier as defined in claim 9 wherein the complementary engaging male and female elements include at least one depending U-shaped prong for reception within an opening provided in said base and tang extending from one side of said base opening for reception within the depending U-shaped prong when each bottle is mounted on said base.

13. The humidifier as defined in claim 12 and including a spaced pair of depending U-shaped prongs for reception within corresponding base openings, and an outwardly extending tang extending from one side of the corresponding base openings for releasable engagement within the depending U-shaped prongs.

14. The humidifier as defined in claim 13 wherein the bottles must be tilted outwardly relative to the humidification unit in order to position the U-shaped prongs for releasable engagement with the spaced tangs of corresponding base openings or for removing each bottle from said base.

15. A humidifier comprising:

a water reservoir base having a central portion and spaced end portions;

a humidification unit mounted on the central portion of said base;

spaced water bottles mounted on the spaced end portions of said base for dispensing water into said base, said bottles being positioned immediately adjacent to and on opposite sides of said humidification unit;

each said bottle being individually removable from said base for re-filling;

said bottles including jointly operating lifting and carrying elements for jointly lifting and carrying the humidifier;

said jointly operating, lifting and carrying elements including spaced U-shaped prongs depending from each bottle for complementary reception within corresponding spaced openings in said base, a tang extending inwardly from one side of said corresponding spaced openings for releasable engagement within each of said depending U-shaped prongs.

16. The humidifier as defined in claim 15 wherein assembly or disassembly of each bottle relative to said base is accomplished by tilting each bottle outwardly relative to said humidification unit, said bottles when positions in proximity to said humidification unit providing joint lifting and carrying of said humidifier.

17. The humidifier as defined in claim 16 and including a removable grill mounted over an opening on said humidification unit to permit removal of a filter having a heighth greater than said opening in said humidification unit by first rotating and then pulling said filter through said opening.

18. A humidifier comprising:

a water reservoir base having a central portion and spaced end portions;

a self-contained humidification unit mounted on the central portion of said base;

spaced water bottles mounted on the spaced end portions of said base for dispensing water into said base, said bottles being positioned immediately adjacent to and on opposite sides of said humidification unit; and a removable grill mounted over an opening on said humidification unit to permit removal of a filter through said opening.

19. The humidifier as defined in claim 18 wherein the filter has a heighth greater than the opening in said humidification unit and a width less than said opening, whereby upon rotating said filter, said filter can be inserted into or removed from the opening in said humidification unit.

20. The humidifier as defined in claim 19 wherein the bottles are individually removable from said base while also providing jointly operating lifting and carrying means for said humidifier.

21. A water bottle for use in a humidifier, comprising:

a bottom wall, an upwardly extending sidewall and a top wall including a handle for carrying the water bottle;

a water bottle dispensing cap mounted over a water dispensing opening formed in the bottom wall of the water bottle; and a water filling cap releasably mounted over a water filling opening formed in the sidewall of the water bottle to facilitate filling.

22. The water bottle as defined in claim 21 wherein the water filling opening is formed in the sidewall in proximity to the bottom wall.

23. The water bottle as defined in claim 21 wherein the sidewall has a substantial heighth and depth with a narrow width.

24. A water bottle for use in a humidifier, comprising:

a bottom wall;

a top wall;

opposed pairs of sidewalls having a substantial heighth and being integrally connected to the bottom wall and top wall;

one opposed pair of sidewalls defining the depth while the other opposed pair of sidewalls defining the width of said water bottle, one opposed pair of sidewalls being spaced from each other by a substantially greater dimension than said other opposed pair of sidewalls;

a water dispensing cap mounted over a water dispensing opening provided in the bottom wall of the container; and a water filling cap releasably mounted over a water filling opening provided in one sidewall of one of said opposed pairs of sidewalls to facilitate filling.

25. The water bottle as defined in claim 24 wherein the water filling opening is provided in one sidewall of said one opposed pair of sidewalls having a substantially greater dimension than said other opposed pair of sidewalls.

26. The water bottle as defined in claim 25 wherein the water filling opening is provided in said one sidewall immediately adjacent to the bottom wall.

27. The water bottle as defined in claim 26 wherein the water filling opening and corresponding water filling cap has a substantially greater dimensional extent than the water dispensing opening and associated water dispensing cap.

28. The water bottle as defined in claim 27 wherein the water filling cap is threadably mounted to said water filling opening.

* * * * *